US005826640A

United States Patent [19]

Lauener

[11] Patent Number: 5,826,640

[45] **Date of Patent: *Oct. 27, 1998**

[54] COOLING SYSTEM FOR A BELT CASTER AND ASSOCIATED METHODS

[75] Inventor: Wilhelm F. Lauener, Gerlafingen/SO, Switzerland

[73] Assignee: Larex A.G., Solothurn, Switzerland

[ * ] Notice: The term of this patent shall not extend beyond the expiration date of Pat. No. 5,671,801.

[21] Appl. No.: 843,528

[22] Filed: Apr. 16, 1997

Related U.S. Application Data

[62] Division of Ser. No. 567,178, Jan. 11, 1996, Pat. No. 5,671,801.

[51] Int. Cl.[6] ..... B22D 11/06; B22D 11/124

[52] U.S. Cl. ..... 164/481; 164/432

[58] Field of Search ..... 164/481, 482, 164/431, 432, 433, 485, 443

[56] References Cited

U.S. PATENT DOCUMENTS

| | | | |
|---|---|---|---|
| 4,061,177 | 12/1977 | Sivilotti | 164/87 |
| 4,061,178 | 12/1977 | Sivilotti | 164/87 |
| 4,190,103 | 2/1980 | Sivilotti et al. | 165/120 |
| 4,193,440 | 3/1980 | Thorburn et al. | 164/432 |
| 4,601,324 | 7/1986 | Artz et al. | 164/432 |
| 4,679,611 | 7/1987 | Yoshida et al. | 164/431 |
| 4,785,873 | 11/1988 | Lauener | 164/481 |
| 4,794,978 | 1/1989 | Lauener | 164/431 |
| 4,798,315 | 1/1989 | Lauener | 222/591 |
| 4,905,753 | 3/1990 | Shio et al. | 164/431 |
| 4,964,456 | 10/1990 | Lauener | 164/481 |

FOREIGN PATENT DOCUMENTS

| | | | |
|---|---|---|---|
| 864035 | 6/1978 | Belgium . | |
| 59-6206743 | 1/1984 | Japan | 164/432 |
| 59-78760 | 5/1984 | Japan | 164/432 |
| 1-237057 | 9/1989 | Japan | 164/431 |
| 1-284462 | 11/1989 | Japan | 164/431 |

*Primary Examiner*—Kuang Y. Lin

*Attorney, Agent, or Firm*—David V. Radack; David W. Brownlee; Eckert Seamans Cherin & Mellott, LLC

[57] ABSTRACT

A cooling system for a belt caster including at least one movable belt. The cooling system includes a plurality of rollers and a plurality of nozzles arranged between the rollers to deliver coolant to the belt. The rollers provide a rolling support surface upon which the belt may be supported and are constructed and arranged so that a maximum number of nozzles can be provided to deliver coolant to the belt of the caster. In another embodiment, the cooling system includes a cooling box having (i) a first chamber for receiving coolant from a coolant supply; (ii) supply tubes for delivering coolant from the first chamber to a second chamber defined by a cooling face of the cooling box and the cooling surface of the belt; and (iii) a third chamber for receiving coolant from the second chamber. Associated methods of casting a molten metal into a metal product are also disclosed.

14 Claims, 11 Drawing Sheets

COOLING SYSTEM FOR A BELT CASTER AND ASSOCIATED METHODS

This is a division of application Ser. No. 08/567,178, filed Jan. 11, 1996, now U.S. Pat. No. 5,671,801.

BACKGROUND OF THE INVENTION

This invention relates to a cooling system for a belt caster and associated methods.

Casters for casting molten metal into a metal product, such as slab, strip or bar are well known. One type of caster is a vertical twin belt caster which includes a pair of opposed movable belts and a pair of opposed movable side dams which together define a mold. Molten metal, such as molten aluminum from a furnace, is introduced into the mold by means of a nozzle. The molten metal is then solidified into a metal product in the mold. The metal product is moved out of the mold at casting speed and is then further processed, such as by hot rolling, in order to make a final product, such as aluminum can sheet or aluminum auto sheet, for example.

In order to efficiently solidify the molten metal into a high quality strip, slab or bar of a metal product, tremendous amounts of heat are transferred from the solidifying molten metal. The more efficiently the heat is transferred from the molten metal the higher the productivity of the caster and the better the microstructure of the cast metal product casting will be. This heat is removed through the belts so there is a need to efficiently cool the backside of the belt with a coolant, such as water. The coolant must be delivered to the back of the belt and then removed therefrom. Thus, a cooling system for a belt caster must be able to deliver tremendous amounts of coolant to the back of the belt while at the same time providing an efficient and substantially leakproof way of removing the coolant after it strikes the backside of the belt.

Although there have been disclosed and operated cooling systems for belt casters (see, e.g., U.S. Pat. Nos. 4,061,177; 4,061,178; 4,679,611 and 4,905,753), there still remains a need for a cooling system which can deliver tremendous amounts of coolant to the backside of the belt while at the same time being able to remove the coolant in an efficient and leakproof way.

SUMMARY OF THE INVENTION

The invention has met or exceeded the above-mentioned needs as well as others. The cooling system includes a plurality of rollers and a plurality of nozzles arranged between the rollers to deliver coolant to the belt. The rollers provide a rolling support surface upon which the belt may be supported and are constructed and arranged so that a maximum number of nozzles can be provided to deliver coolant to the belt of the caster. In another embodiment, the cooling system includes a cooling box having (i) a first chamber for receiving coolant from a coolant supply; (ii) means for delivering coolant from a first chamber to a second chamber defined by a cooling face of the cooling box and the cooling surface of the belt; and (iii) a third chamber for receiving coolant from the second chamber.

Associated methods of casting a molten metal into a metal product are also provided. In one method, a belt caster including a movable belt is provided, the belt being passed through a casting zone. Coolant is delivered to the cooling surface of the belt by means of a plurality of nozzles disposed between a plurality of rollers. Molten metal is then introduced into the mold of caster and solidified therein in order to form the metal product. A second method involves providing the cooling box of the invention and delivering coolant to the belt of the caster through the cooling box. Molten metal is again introduced into the mold and solidified therein in order to form the metal product.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

Figure 1:
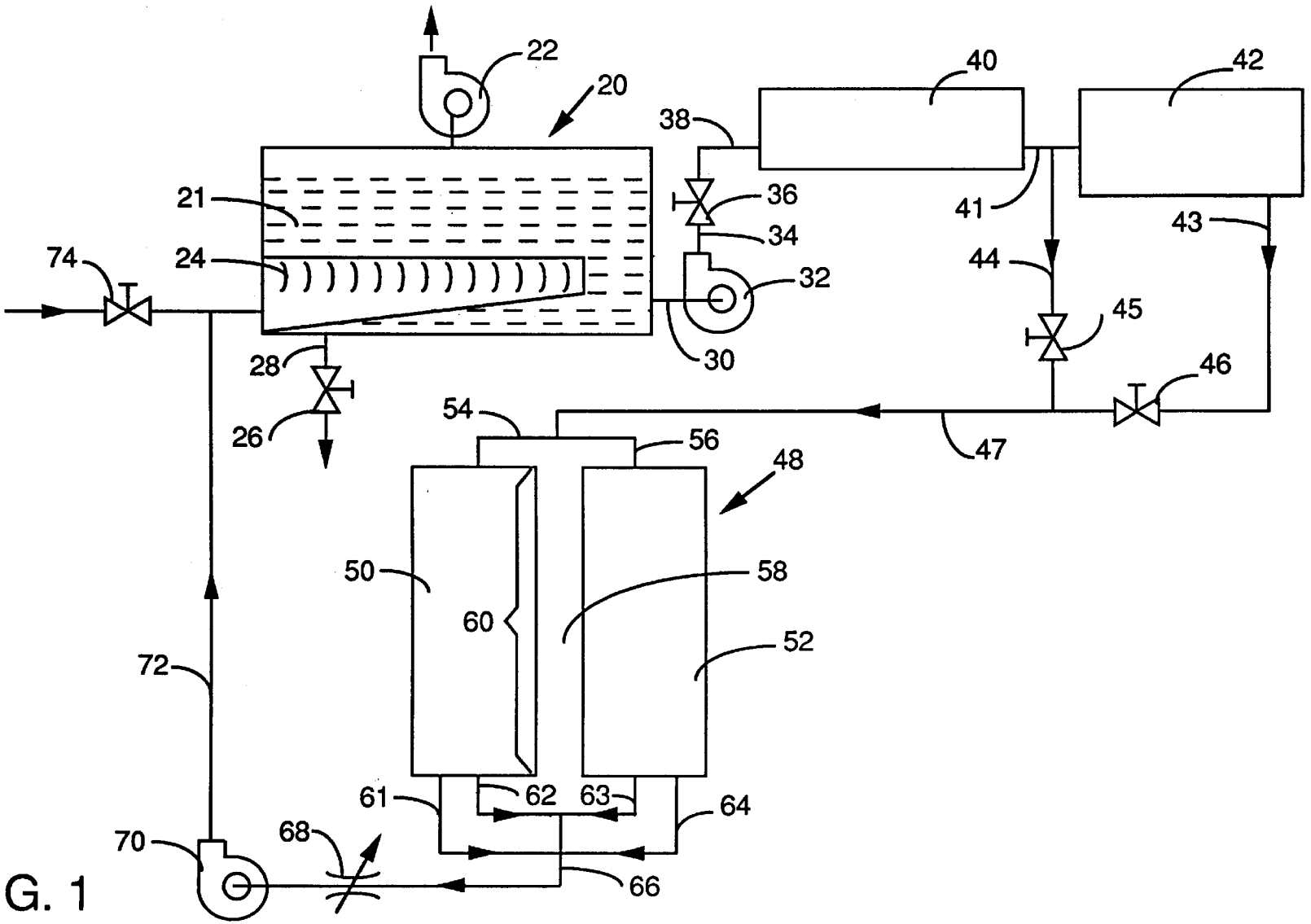
FIG. 1 is a schematic diagram of a twin belt caster including the cooling system of the invention.

FIG. 1 is a schematic diagram of the cooling system of the above-captioned invention. The cooling system includes a coolant supply reservoir 20 which contains the coolant fluid, usually water 21, which is used in the cooling system. The reservoir 20 is equipped with a vent fan 22 which exhausts air from the reservoir 20 as well as an air separator 24 which separates air from the water as it enters the reservoir 20. Valve 26 is a drain valve that can be used to empty water from the tank through line 28. This water can then go into the municipal water/sewage system.

Figure 5:
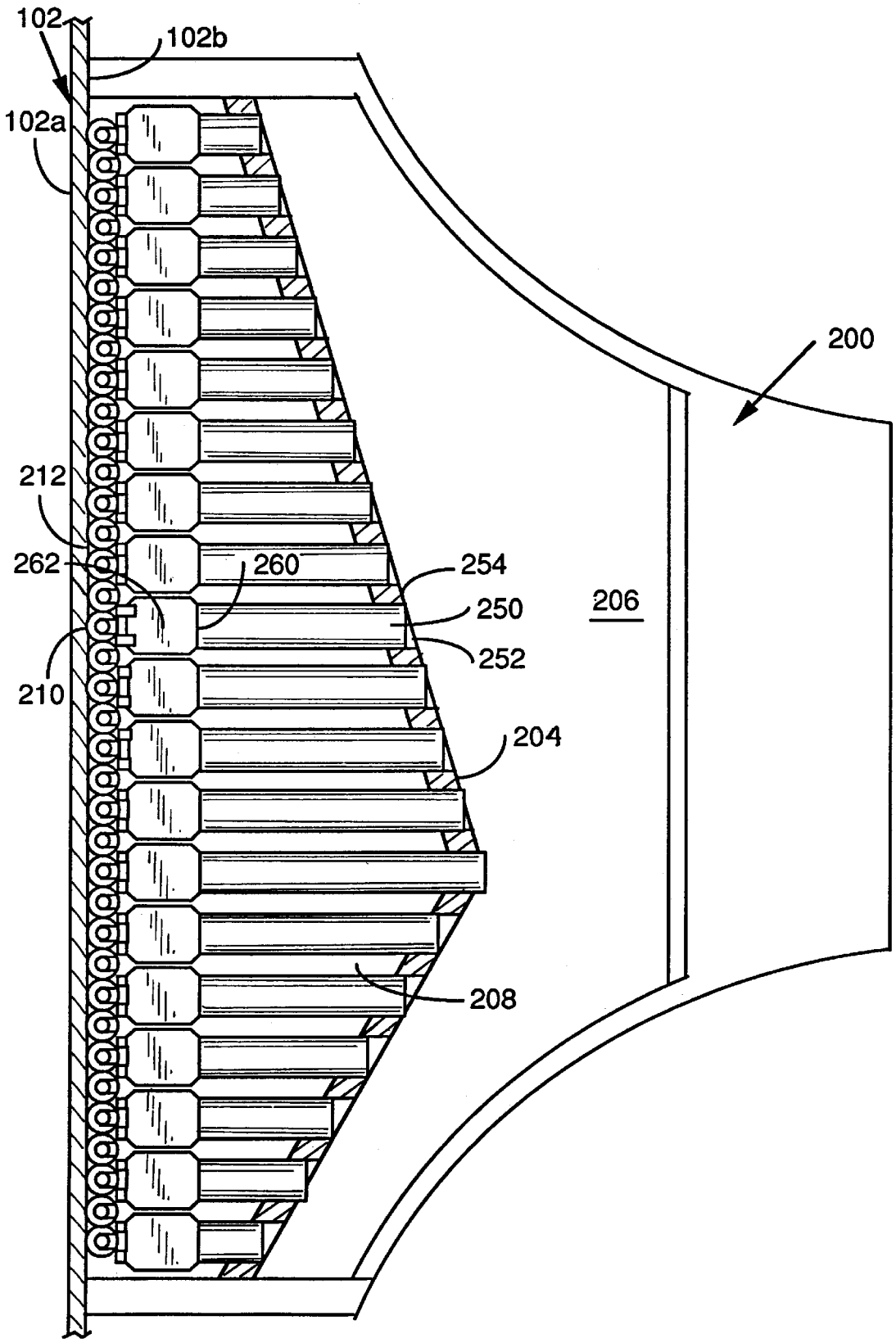
FIG. 5 is a vertical cross-sectional view of the cooling box of the invention.
Figure 6:
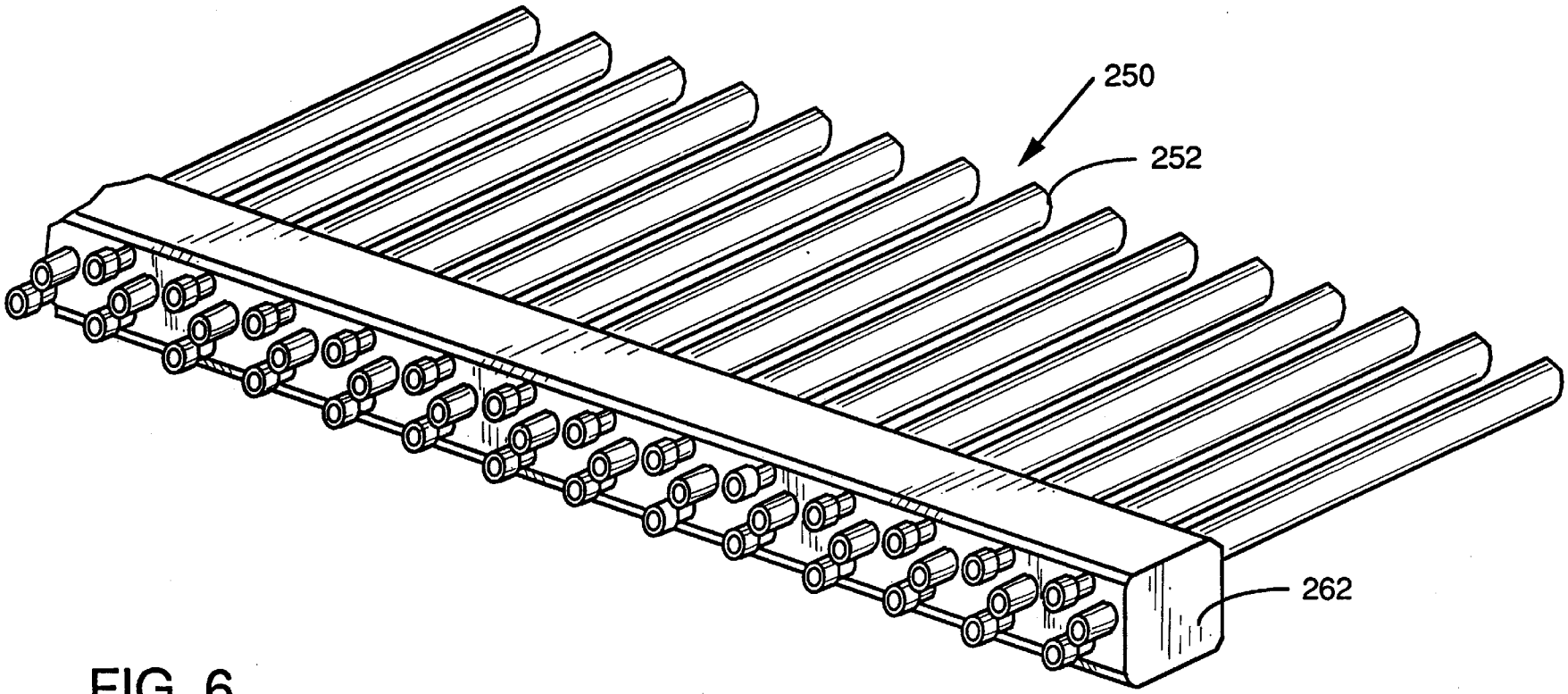
FIG. 6 is a perspective view of an assembly consisting of the supply tubes, manifold and nozzles of the invention before the same assembly is placed in the cooling box.

The water 21 is circulated from the reservoir 20 through pipe 30 by a pump 32. This pump 32 delivers the water 21 from the reservoir 20 at the rate of 200–220 liters/second per square meter of cooling surface of the cooling box. The water 21 then flows through pipe 34 to a gate valve 36 which is used to adjust the pressure of the water 21 in the cooling system in the chamber 208 (FIG. 5). From there, the water flows through pipe 38 into a filter 40. The filter 40 removes any dirt or other particulate matter from the water 21 before the water is introduced to the caster, as will be explained below.

From the filter 40, the water flows into pipe 41. At this point, the water 21 can flow into a cooler 42, if it is desired to cool the water 21 further. The water 21 flows out of the cooler 42 through line 43 and then into the cooling boxes of the caster, as will be explained below.

It has been found that the water temperature that gives the best cooling rate in the caster is about 20° C. to 40° C. with 25° C. to 35° C. being preferred. As the water is circulated through the caster, however, the temperature of the water 21 increases. In order to cool the water, the cooler 42 can be used. For short casting runs, the cooler 42 may not be needed. If this is the case, the water 21 does not flow into the cooler 42 but instead flows through line 44 to then be introduced into the cooling boxes of the caster as will be explained below. Alternatively, water from the cooler 42 can be mixed with hot water from the caster to obtain a desired water temperature. The flow of the water 21 either into or bypassing the cooler 42 is controlled by two valves, valve 45 on line 44 and valve 46 on line 43. It will be appreciated that by closing valve 45 and opening valve 46 that the water 21 flows from line 41 into the cooler 42 and then through line 43 and into line 47 and then to the caster 48. Alternatively, to bypass the cooler 42, valve 46 is closed and valve 45 is open so that the water 21 flows through line 44 and then into line 47 for subsequent introduction into the caster 48.

The water 21 is then ready to be delivered to the cooling boxes 50, 52 behind each belt of the caster 48 by respective pipes 54, 56 branching from pipe 47. The cooling boxes 50, 52 will be described in much greater detail hereinafter, but suffice it to say at this point that the water 21 is delivered to the cooling boxes 50, 52 and the water is then directed to flow against the back of the belts (not shown in FIG. 1) to cool the belts as molten metal is being solidified in the mold 58 of the caster 48. The metal product which is solidified in the mold 58 is moved out of the casting zone 60 at casting speed, and then is processed further, such as by hot rolling and cold rolling, to form a final metal product, such as aluminum can or auto sheet. Once the water 21 has flowed against the back of the belts, it is removed therefrom by means of a reduced pressure, preferably subatmospheric pressure, through pipes 61, 62, 63, 64 which are connected to pipe 66. A throttle valve 68 is used to adjust the pressure in the pipe 66 and thus in chamber 208 (FIG. 5). The pressure can also be adjusted by changing the rpm of the pump 70. It will be appreciated that pump 70 can pump air and water, as the coolant exiting the cooling boxes 50, 52 contains about 95% water and 5% air, The water 21 is then pumped through pipe 72 back to the reservoir 20 for recirculation into the cooling system. A valve 74 is preferably provided for feeding fresh water, for example from a municipal water system, to be introduced into the reservoir, if desired. It will be appreciated that the cooling system of the invention provides a continuous, closed loop system in which coolant 21 is circulated from the reservoir 20 to the caster and then back to the reservoir 20.

Figure 2:
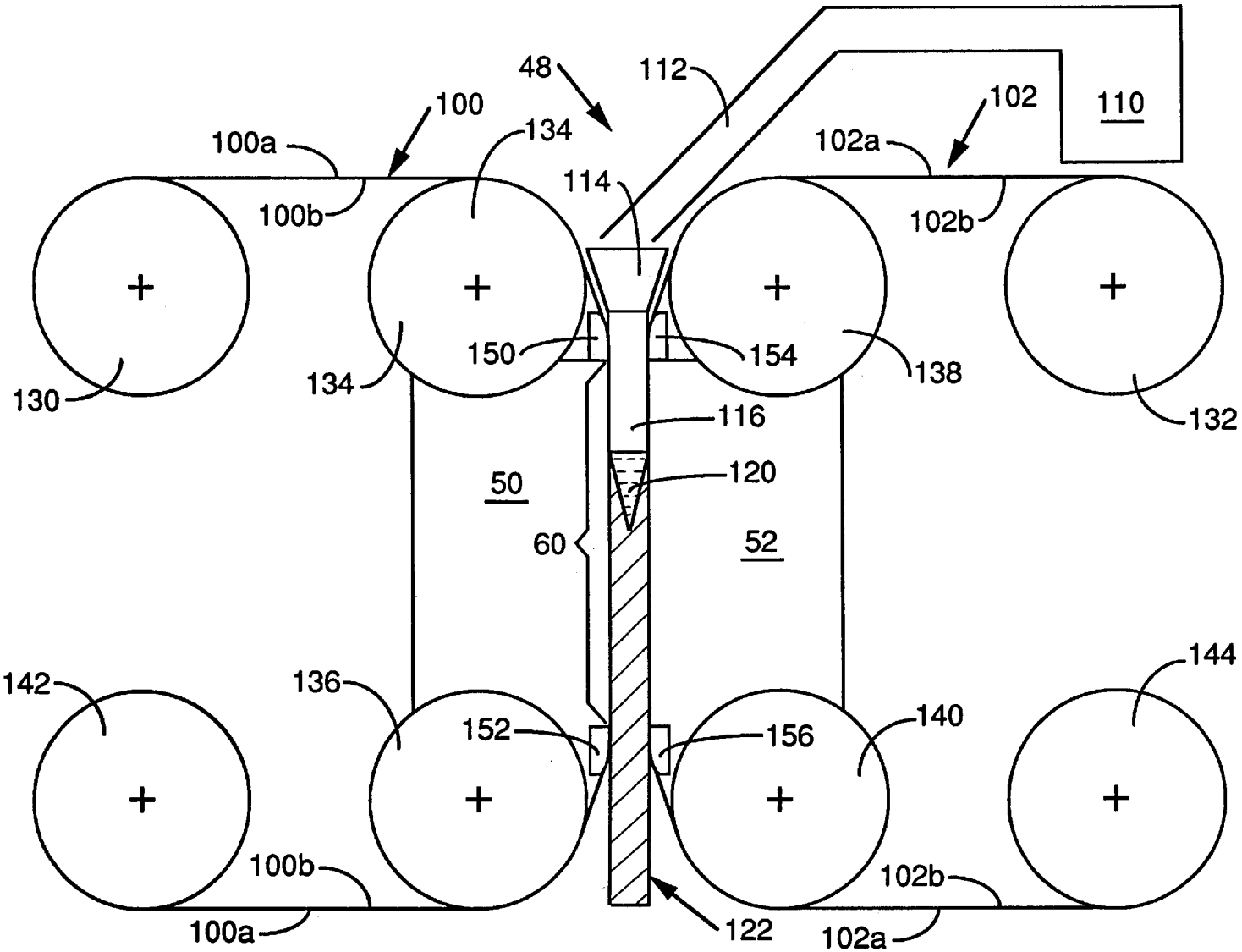
FIG. 2 is a partially schematic side-elevational view of the twin belt caster shown in FIG. 1.

FIG. 2 is a side elevational view of the caster 48, showing the cooling boxes 50 and 52 disposed behind a pair of movable belts 100 and 102, respectively. In this view, the side dams for the caster are not shown, but it will be appreciated that the belts 100 and 102, along with the movable opposed side dams define the mold 58 (FIG. 1) in the casting zone 60.

Molten metal is delivered to the mold 58 from a furnace 110 having a trough 112 leading therefrom. The furnace 110 and trough 112 are shown in schematic form in FIG. 2. The molten metal in the trough 112 is delivered to a tundish 114 and then into a nozzle 116. For a more detailed description of a nozzle that can be used, see U.S. Pat. No. 4,998,315, the disclosure of which is expressly incorporated herein by reference.

The nozzle 116 introduces the molten metal into the mold 58. The molten metal 120 from the nozzle 116 starts out in a molten form but as it moves through the casting zone 60, the molten metal 120 solidifies into a metal product 122. The metal product 122 is then moved out of the casting zone 60 for further processing, such as hot rolling, in order to form the final metal product, such as can sheet or auto sheet, for example.

The belts 100 and 102 are unwound from upper coils 130, 132 and then guided by pulleys 134, 136 and 138, 140, respectively, through the casting zone 60. The belts 100 and 102 are then wound onto lower coils 142 and 144. Belt shoes 150, 152. and 154, 156 are also provided to help guide the respective belts 100 and 102 through the casting zone 60. It will be appreciated that although FIG. 2 shows an open ended belt for a vertically oriented caster, that the invention disclosed herein is not limited to this type of caster and can be used with other types of casters, such as those using endless belts, and casters which are either generally vertically oriented or generally horizontally oriented.

Each of the belts 100, 102 has a first major surface 100*a*, 102*a* and a second major surface 100*b*, 102*b*. The belts 100, 102 can have any desired width and a thickness ranging from about 0.25 mm to 0.635 mm or 0.75 mm. As shown in FIG. 2, the first major surfaces 100*a*, 102*a* are exposed to the molten metal in the casting zone 60, whereas the second major surfaces 100*b* and 102*b* (or cooling surfaces) are exposed to the respective cooling boxes 50 and 52. It will be appreciated that the water from the cooling boxes 50, 52 strikes the second major surfaces 100*b* and 102*b* of the belts 100 and 102 in order to cool the belts 100 and 102 as well as remove heat from the solidifying molten metal in the mold. 58. As may be sometimes used herein, the term "front of the belt" refers to the first major surface 100*a* or 102*a* of the respective belt 100 or 102 and the term "back of the belt" or "cooling surface" refers to the second major surface 100*b* or 102*b* of the respective belt 100 or 102.

For a more detailed description of a twin belt caster, see U.S. Pat. No. 4,964,456, the disclosure of which is hereby expressly incorporated by reference herein.

Figure 3:
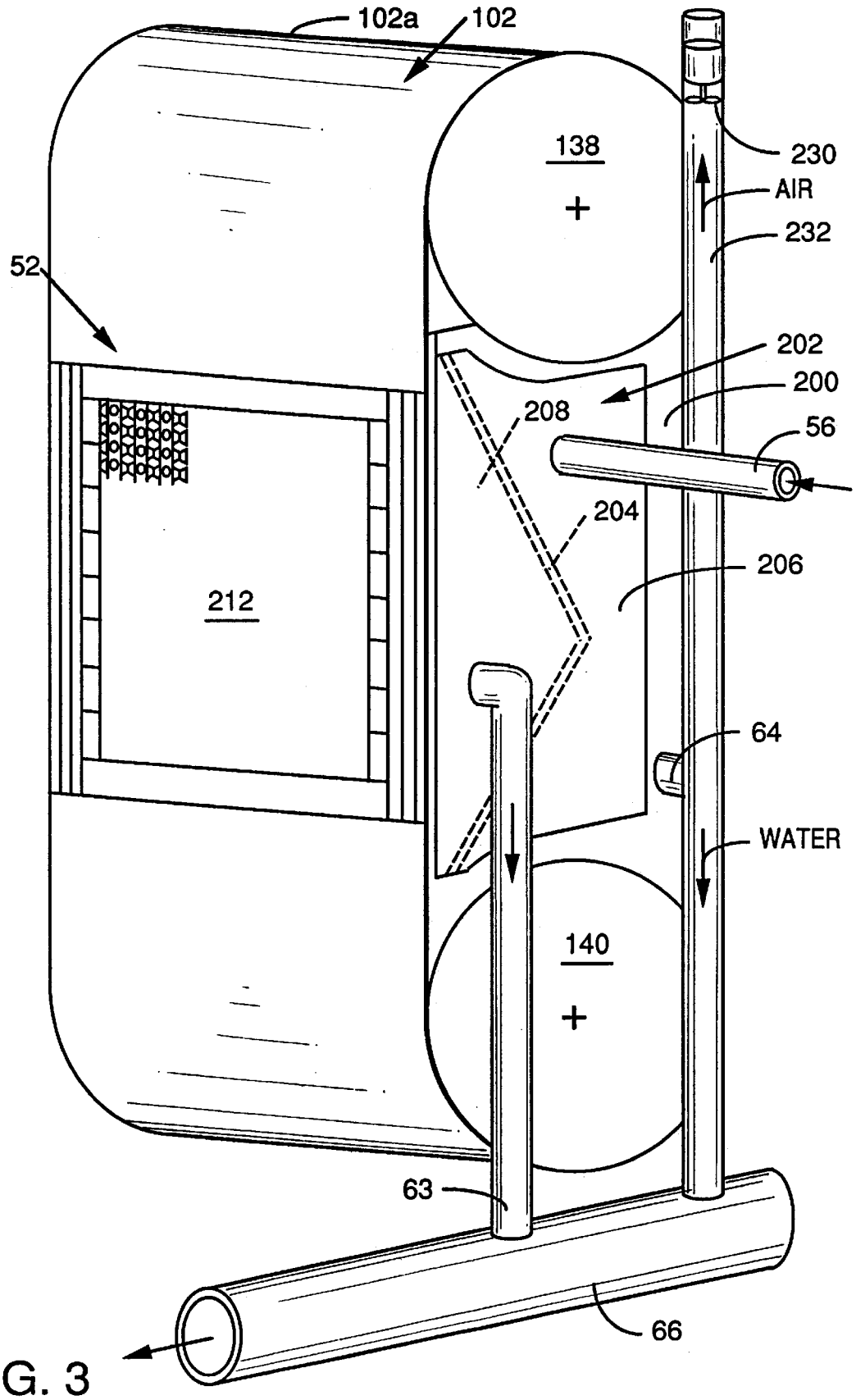
FIG. 3 is a perspective schematic view of the cooling box of the system.
Figure 4:
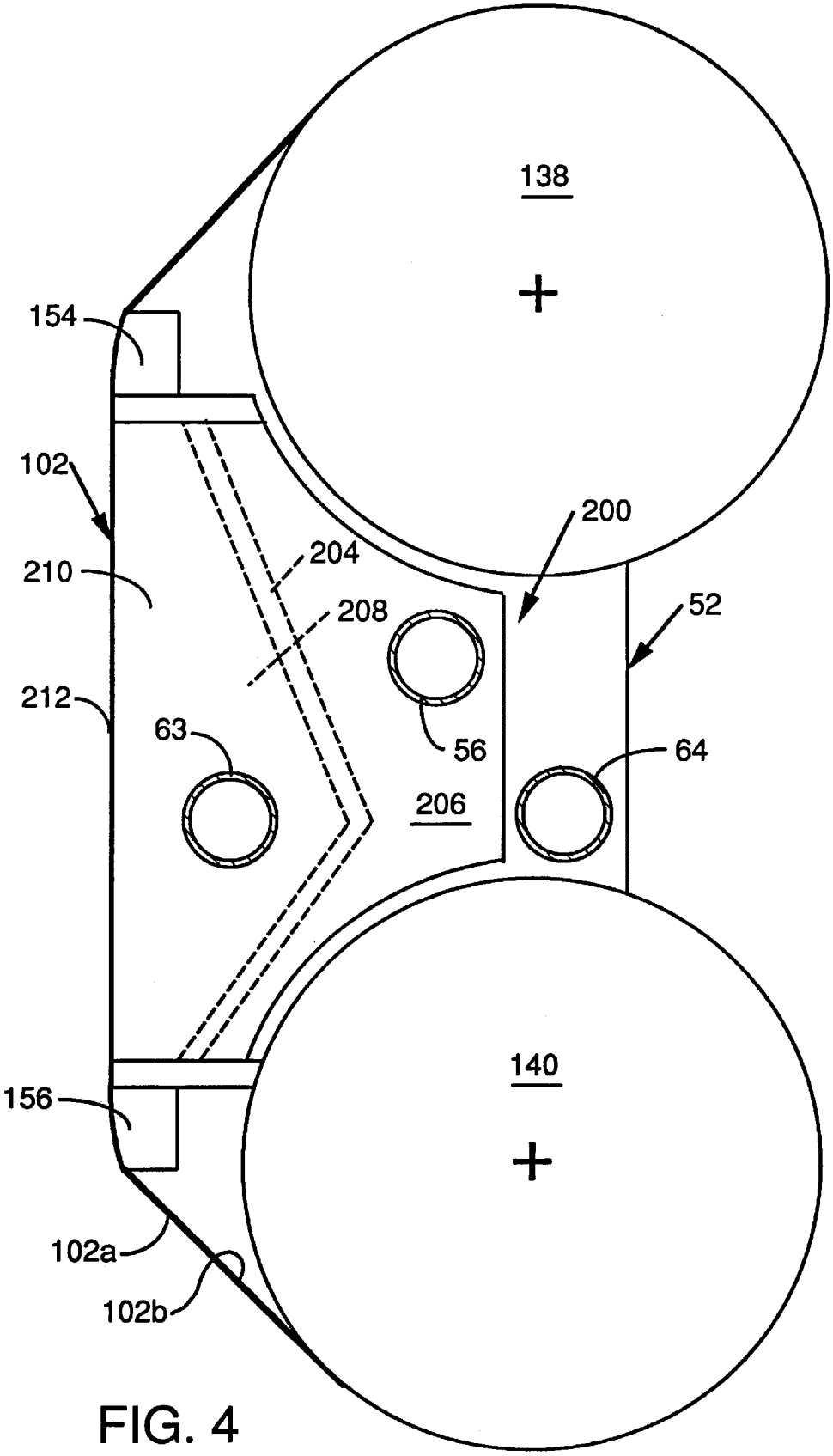
FIG. 4 is an elevational view of the cooling box shown in FIG. 3.

Referring now to FIGS. 3–13, the operation of cooling box 52 will be discussed in detail. It will be appreciated that cooling boxes 50 and 52 operate similarly so only cooling box 52 will be explained. As can be seen in FIG. 3, cooling box 52 consists of an outer box 200 that substantially, and preferably completely, surrounds an inner box 202. The general operation of the cooling box 52 is that coolant water 21 is delivered by pipe 56 (see also FIG. 1) into the inner box 202. The inner box 202 is divided into two chambers by a wall 204, the wall 204 creating a coolant delivery chamber 206 and a coolant removal chamber 208. The coolant 21 is delivered by pipe 56 into the coolant delivery chamber 206. After delivery thereto, the coolant is directed towards a chamber 210 (FIG. 5) formed by the front of cooling face 212 of the inner box 202 and the backside 102*b* of the belt. After the coolant strikes the backside 102*b* of the belt 102, it is removed from chamber 210 by pipe 63 and then into pipe 66. The coolant is removed by a negative pressure created by pump 70 (FIG. 1). The coolant then recirculates through the system as was explained in FIG. 1.

Although the front face 212 of the inner box 202 is sealed against the belt 102 (as will be explained below in detail with respect to FIG. 13) some coolant may not be removed through coolant removal chamber 208 by pipe 63. This coolant, however, is removed through outer box 200 which also has a pipe 64 that is connected to pipe 66. Because of this a negative pressure is also created in outer box 200 so that any coolant that is not removed from chamber 208 by pipe 63 is received into outer box 200 and removed therefrom. This coolant flows through pipe 64 and into pipe 66 to be recirculated in the cooling system along with coolant from the inner box 202. The vacuum fan 230 serves several functions. When coolant is initially introduced into chamber 208, fan 230 creates an underpressure in the chamber 208 so that coolant can be removed therefrom through pipe 63. The vacuum created also draws belt 100 initially against the rollers of the cooling box and provides a seal on the side of the belt 100 so that coolant water does not leak. During initial start-up and at all times thereafter, the vacuum fan 230 removes air that is mixed in with the coolant. This air is introduced into the coolant from the ambient environment. This air is removed from outer box 200 through pipe 64 and pipe 66. The vacuum fan 230 also creates an under pressure in the cooling box 50.

Referring now to FIGS. 4–7, a detailed explanation of the delivery and removal of the coolant from chamber 210 will be discussed. The coolant enters the coolant delivery chamber 206 through pipe 56. In order to pass from chamber 210, a series of supply tubes, such as supply tube 250, are provided (FIG. 5). The supply tubes are disposed in a substantially perpendicular relationship to the cooling face 212 and belt 102 and have a first open end 252 that communicates with chamber 206. The supply tube 250 then passes through a hole 254 in wall 204 which separates chamber 206 from chamber 208. The supply tube 250 also has a second open end 260 which communicates with a manifold 262 that is disposed generally parallel to the belt 102 and which extends transversely across the cooling face 212 of the inner box 202. It will be appreciated that each manifold receives a plurality of supply tubes, as can best be seen in FIG. 6, which shows several supply tubes, such as supply tube 250, being received into manifold 262.

Figure 7:
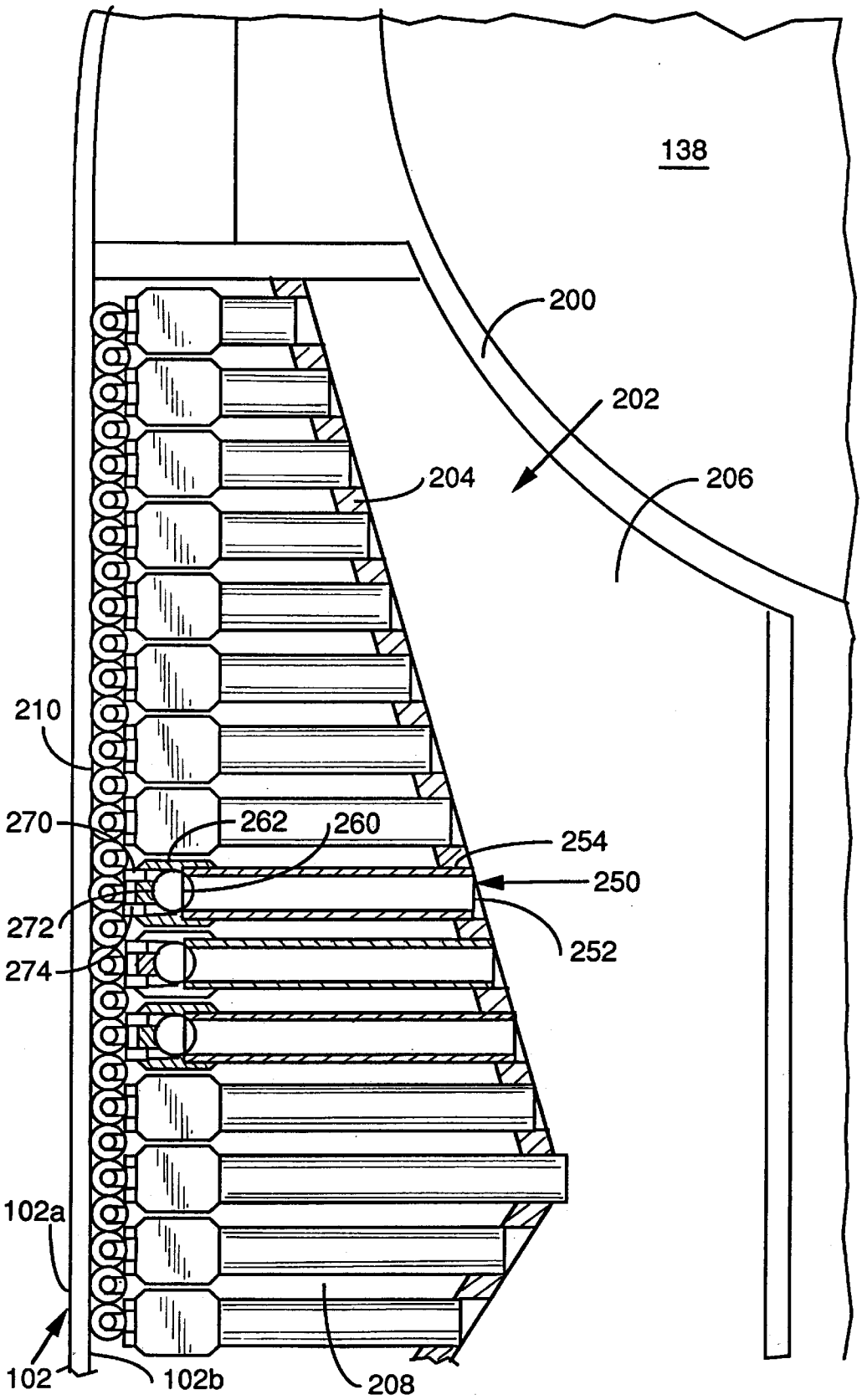
FIG. 7 is a detailed view of a portion of FIG. 5.
Figure 8:
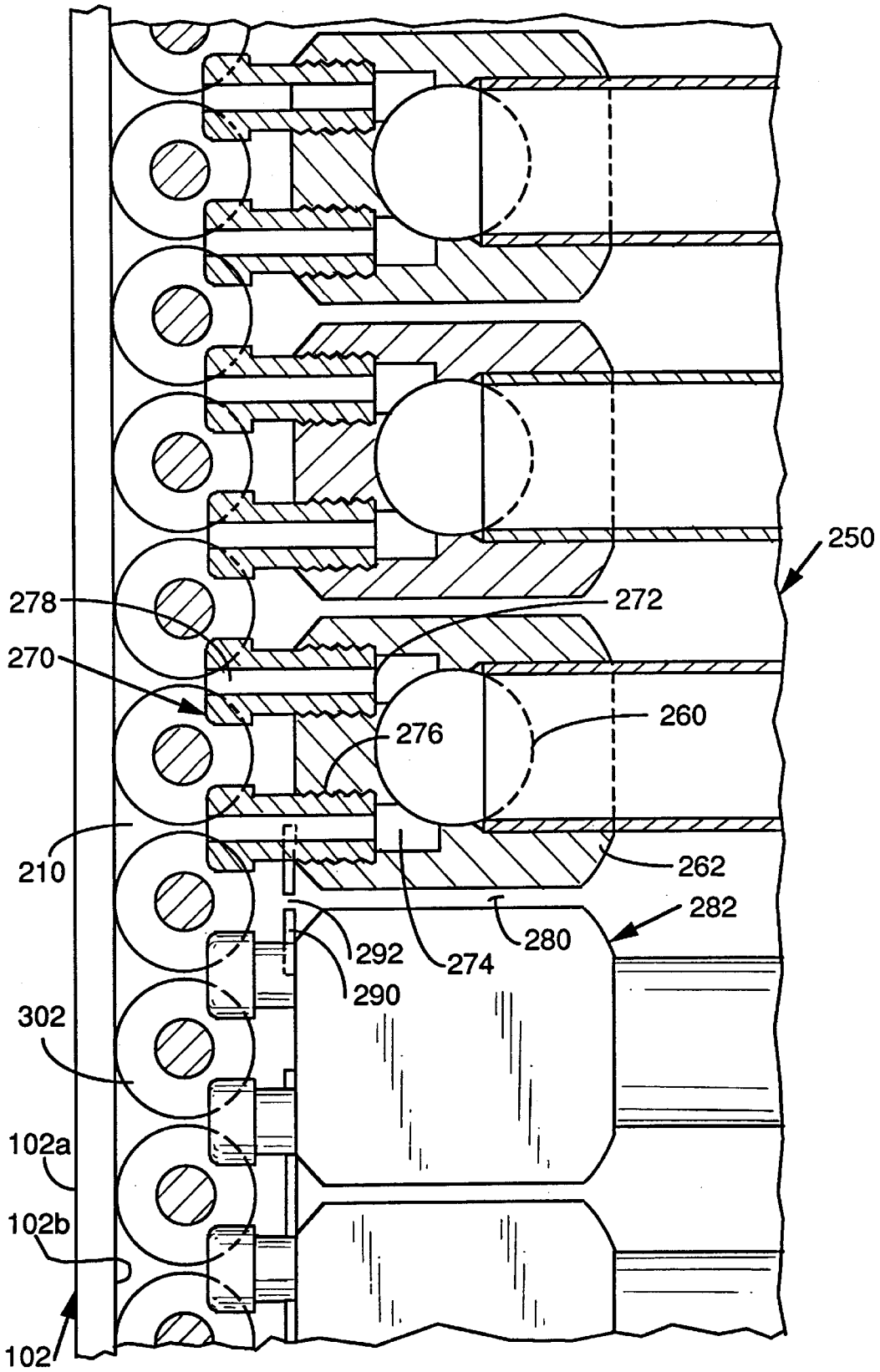
FIG. 8 is an even more detailed view of a portion of FIG. 7.

Referring more particularly to FIGS. 7 and 8, the coolant in the manifolds is then delivered to a series of nozzles, such as nozzle 270 for delivery into chamber 210 and thus to the backside 102*b* of the belt 102. Each manifold includes a plurality of passageways, such as passageways 272, 274, in which is disposed a nozzle, such as nozzle 270 in passageway 272. The nozzle 270, which will be explained in greater detail below, includes a threaded end 276 which is threaded into the passageway 272 and an open end 278 which delivers the coolant to the backside 102*b* of the belt 102. After striking the backside 102*b* of the belt 102, the coolant is drawn away from chamber 210 through passageways defined by longitudinally adjacent manifolds, such as passageway 280 between manifold 262 and manifold 282. The gap can also be seen by observing FIG. 9, which shows a plurality of such gaps. The coolant is then received in coolant removal chamber 208 and removed therefrom through pipe 63 and then into pipe 66, as was explained above, for recirculation in the system.

Figure 9:
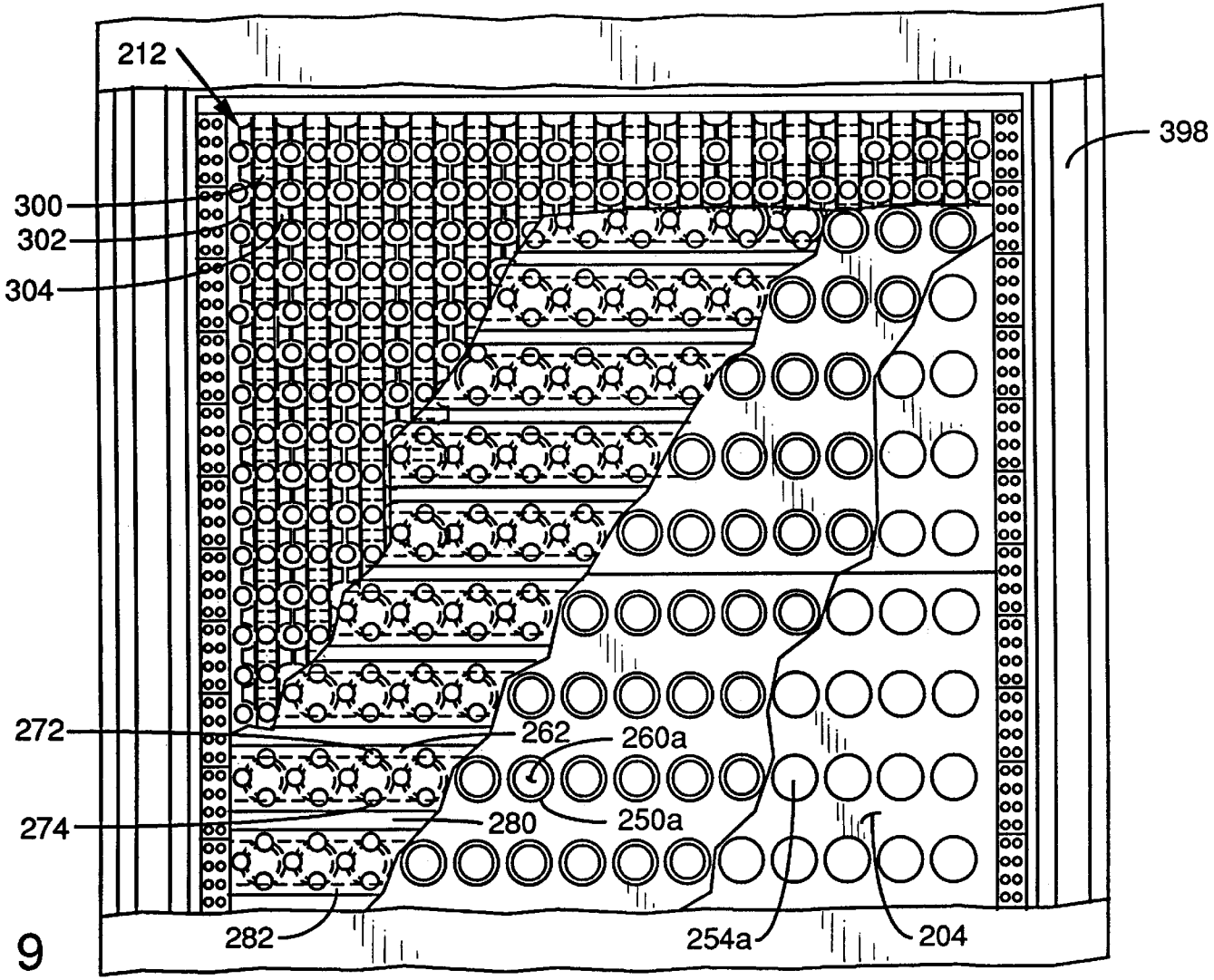
FIG. 9 is a front elevational view, with layers peeled away, of the cooling face of the invention.

Referring now to FIG. 9, a detailed view of the cooling face 212 of the inner box 202 is shown. The cooling face includes a plurality of columns of bronze bearing blocks such as bearing block 300 which include rollers, such as rollers 302, 304. The rollers extend outwardly from the bearing blocks and provide a rolling surface upon which the belt 102 is supported, as can be seen in FIG. 8. As can be seen in FIG. 9, the bearing blocks include several openings in which are disposed nozzles, such as nozzle 270 (FIGS. 7–8). The bearing blocks and rollers are also constructed and arranged such that a nozzle opening is defined between the rollers as will be explained in detail with reference to FIGS. 10–12. FIG. 9 also shows layers of the cooling face 212 being peeled away to show the various elements of the coolant delivery system. The manifold 262 is shown with passageways 272 and 274 made therein. As discussed above, the coolant 21 is delivered into the manifold 262 by means of supply tubes, such as supply tube 250 (FIGS. 5–8). FIG. 9 more clearly shows a supply tube 250*a* which delivers coolant 21 into manifold 262. Finally, FIG. 9 also shows a front view of the partition wall 204 with an opening 254*a* through which a supply tube is disposed. This opening is similar to opening 254 shown in FIGS. 5–8.

It will be appreciated, therefore, that the coolant 21 is delivered into coolant delivery chamber 206 by pipe 56 and is transported by supply tubes, such as supply tubes 250 and 250*a* to manifolds, such as manifold 262 for subsequent delivery to nozzles, such as nozzle 270. Nozzle 270 has a nozzle opening 271 (FIG. 12) which has a diameter of between about 0.8 mm to 1.5 mm. The coolant 21 then strikes the back of the belt 102*b* in chamber 210 and is removed from chamber 210 into coolant removal chamber 208.

Figure 10:
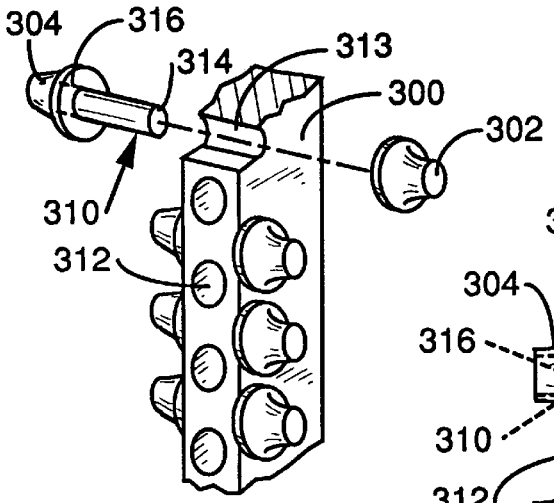
FIG. 10 is an exploded perspective view of the bearing block and rollers of the invention.
Figure 12:
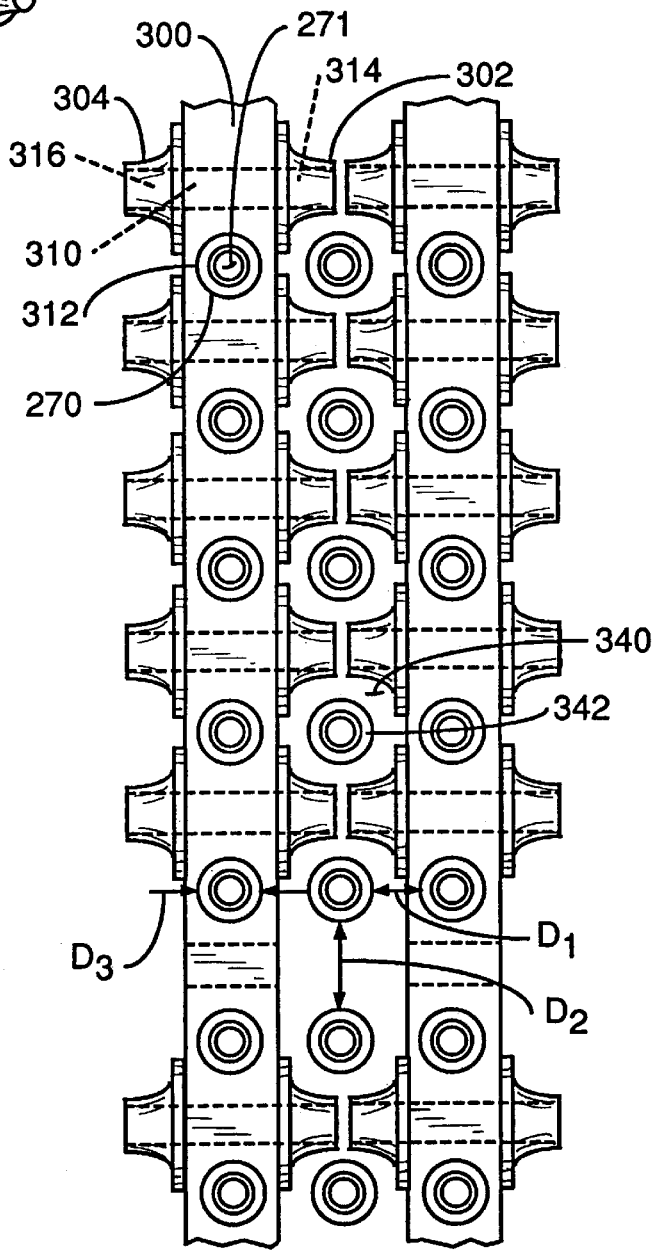
FIG. 12 is a front elevational view of adjacent bearing block assemblies.
Figure 11:
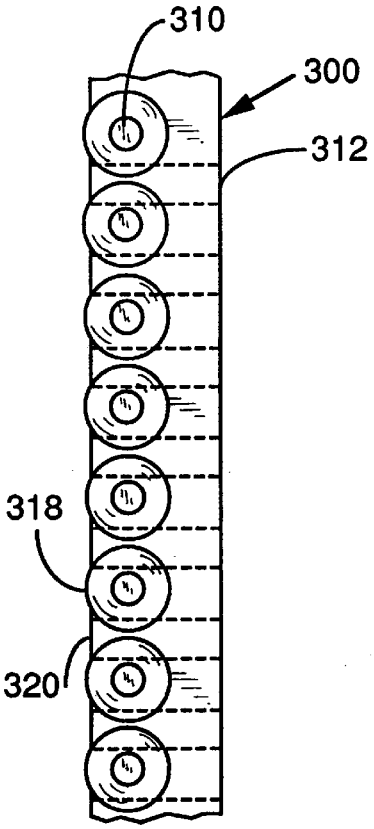
FIG. 11 is a side elevational view of an assembled bearing block with rollers.

FIGS. 10–12 show a portion of bearing block 300. The bearing block 300, which is made of bronze, includes a plurality of openings, such as opening 312, into which is threaded a nozzle, such as nozzle 270. As can be seen in FIG. 8, the nozzle 270 is secured to the manifold 262, thus securing the bearing block 300 to the manifold 262 and in turn creating the cooling face 212 of the cooling box 202. The rollers are disposed on each side of the bearing block and are secured thereto by means of a roller shaft 310 partially disposed in a roller shaft opening 313. Roller shaft 310 has connected to end 314 thereof stainless steel roller 302 and an opposite end 316 having connected thereto roller 304. The roller shaft 310 is free to rotate in passageway 312. As can be seen in FIG. 11, the rollers have a portion 318 that extend from the face 320 of the bearing block.

Referring to FIG. 12, a detailed front elevational view of two adjacent bearing blocks is shown. The rollers are designed to define a space 340 in which is disposed a nozzle 342. The rollers 302, 304 shown include a cylindrical portion which provides a relatively thin rolling surface and a generally frustroconical portion, preferably curvilinear or fluted (outwardly concave) as shown, so as to provide or establish the space 340 between rollers to allow for (i) the nozzle and (ii) coolant flow around the nozzle. This permits a large number of nozzles to be placed in a small area along with sufficient area for coolant movement to and from the belt in order to increase cooling efficiency while also providing sufficient roller support for the belt. The horizontal distance $D_1$ between two nozzles is about 5 mm to 15 mm, preferably about 11 mm or 12 mm, and the vertical distance $D_2$ between two nozzles is preferably about 13 mm. This close spacing enables a uniform high density water supply to the back of the belt which in turn facilitates a high heat transfer and a cool operating temperature for the belt which promotes belt stability.

The pressure of the coolant against the backside 102*b* of the belt 102 can be adjusted by using different sized nozzles and also by adjusting the cross-section of passageway 280. This can be done, for example, by mounting plates, such as plate 290, across the passageway 280. These plates can have an opening, such as opening 292 in plate 290, or can have no opening and thus blocking completely the passageway 280. As the molten metal flows down into the mold, the water pressure down the length of the casting zone needs to be adjusted. It is crucial to keep the belt in contact with the solidifying metal product in order to prevent surface defects. This is done by increasing the pressure of the coolant through the nozzles that are in the lower portion of the casting zone, in order for the belt to remain in contact with the surface of the shrinking metal product as it solidifies.

Figure 13:
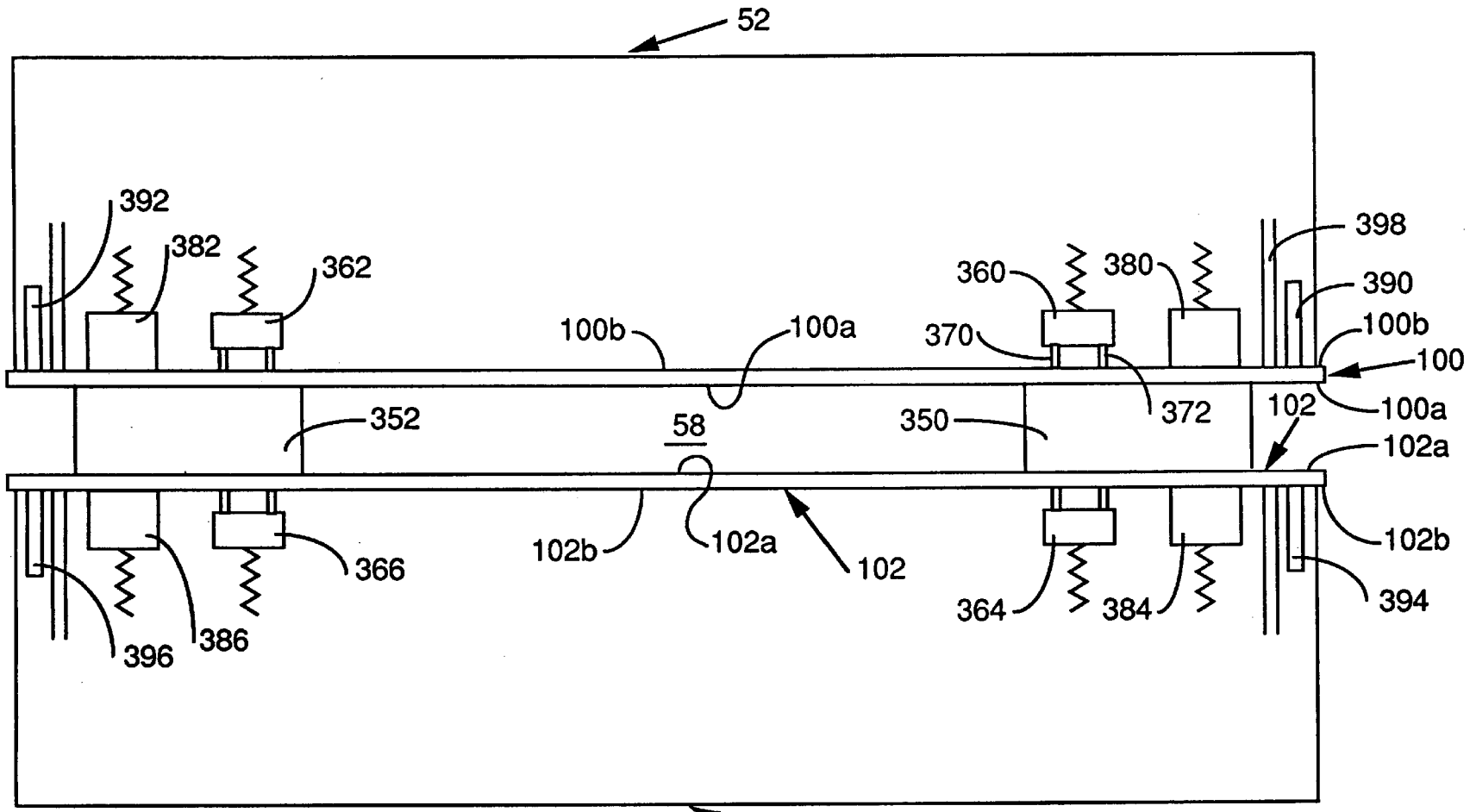
FIG. 13 is a horizontal cross-section showing the sealing means of the invention.

Referring back to FIG. 9, and to FIG. 13, the sealing means of the cooling face will be discussed. FIG. 13 shows the mold 58 defined by belts 100 and 102 along with side dams 350 and 352. The cooling box 52 includes spring biased seals 360, 362 on opposite sides thereof. Spring biased seals 364 and 366 are provided for cooling box 50. These spring biased seals includes nozzles, such as nozzles 370 and 372 for spring biased seal 360. The seals 360, 362, 364 and 366 serve several purposes. One purpose is to seal the belt and side dam. Another purpose is to seal between the belt and chamber 210. The nozzles 370, 372 are for cooling the side dam. A second set of seals are shown disposed outside of seals 360, 362, 364 and 366. These, seals 380, 382, 384, 386 are also spring biased, but do not contain openings for the nozzles. Finally, outer seals 390, 392, 394, 396 are provided.

Referring back to FIG. 9, an opening, such as opening 398, is provided between the middle seal and outer seal, such as middle seal 380 and outer seal 390, in order to collect leaked coolant in the outer box 202.

The invention includes a method of casting molten metal into a metal product. The method comprises providing a belt caster that defines a mold for casting a molten metal into a metal product, the caster including a movable belt having a cooling surface and a casting surface and passing the belt through a casting zone including a mold. The method then comprises delivering a coolant to the cooling surface of the belt by means of a plurality of nozzles disposed between a plurality of rollers. Molten metal is then introduced into the mold and solidified therein into a metal product.

A further invention includes a method of casting molten metal into a metal product comprising providing a belt caster that defines a mold for casting the molten metal into a metal product, the caster including (i) a movable belt having a cooling surface and a casting surface and (ii) a cooling box having a first chamber, means for delivering a coolant from the first chamber to a second chamber defined by the cooling face of the cooling box and the cooling surface of the belt and a third chamber. The method then comprises passing the belt through a casting zone including the mold, supplying the coolant from a coolant supply to the first chamber and delivering the coolant from the first chamber to the second chamber through the delivering means so that the coolant is applied to the cooling surface of the belt. The method then comprises introducing the coolant from the second chamber into the third chamber and removing the coolant from the third chamber. Molten metal is then introduced into the mold and solidified therein into a metal product.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method for a substantially vertical belt caster including at least one movable belt that passes through a casting zone where molten metal is cast into a metal product, said cooling system including (i) a plurality of rollers rotatably mounted on a plurality of bearing blocks; (ii) a plurality of nozzles arranged in said bearing blocks between said rollers to deliver coolant under pressure to said belt to cool the belt and to keep it in contact with said molten metal as it solidifies into said metal product, (iii) means for removing substantially all of said delivered coolant from said belt before said belt exits said casting zone; and (iv) means for adjusting the pressure of said coolant delivered to said belt along the length of said casting zone.

2. The cooling system of claim 1, wherein said rollers are rotatably mounted to a plurality of bearing blocks.

3. The cooling system of claim 2, wherein each said bearing block includes at least one bearing shaft, each of said bearing shafts having a first and second end portions which extend from opposite sides of said bearing block, a separate said roller being secured to each of said first and second end portions.

4. The cooling system of claim 3, wherein said rollers have a generally cylindrical portion and a generally frustroconical portion.

5. The cooling system of claim 4, wherein said bearing blocks define a plurality of openings in which said nozzles are disposed.

6. The cooling system of claim 5, wherein said rollers are constructed and arranged such that a plurality of spaces are defined between said rollers with said nozzles being disposed in said spaces.

7. The cooling system of claim 6, wherein said nozzles each include a nozzle opening, said nozzle opening being generally circular and about 0.8 to 1.5 mm in diameter.

8. The cooling system of claim 7, wherein said rollers are made of stainless steel.

9. The cooling system of claim 1, wherein said rollers are arranged in a generally planar arrangement to provide a rolling support surface upon which said belt may be supported.

10. A method of casting molten metal into a metal product, said method comprising;

providing a substantially vertical belt caster that defines a mold in a casting zone for casting said molten metal into said metal product, said caster including a movable belt having a cooling surface and a casting surface opposite said cooling surface;

passing said belt through a casting zone including said mold;

delivering a coolant under pressure to said cooling surface of said belt through a plurality of nozzles disposed between a plurality of rollers and arranged in bearing blocks on which said rollers are rotatable mounted to maintain contact of the belt with said solidifying molten metal, said rollers arranged to limit movement of said belt towards said nozzles;

varying the pressure of said coolant delivered to said cooling box chamber along the length of said cooling face for said belt to maintain contact of the belt with said solidifying molten metal, removing sid coolant from said cooling surface of said belt after said coolant has been delivered thereto so that substantially all of said delivered coolant is removed from said cooling surface before said belt exits said casting zone;

introducing said molten metal into said mold; and solidifying said molten metal in said mold into said metal product.

11. The method of claim 10, including varying the pressure of said coolant delivered to said cooling box chamber along the length of said cooling face in order for said belt to maintain contact with said solidifying molten metal.

12. The method of claim 10, including employing as said belt caster a twin belt caster having a pair of movable opposed belts; and delivering said coolant to both belts by means of separate sets of nozzles and rollers.

13. The method of claim 12, including employing as said twin belt caster a generally vertically oriented twin belt caster.

14. The method of claim 10, including casting molten aluminum in said caster.

* * * * *

UNITED STATES PATENT AND TRADEMARK OFFICE

CERTIFICATE OF CORRECTION

PATENT NO. : 5,826,640

DATED : October 27, 1998

INVENTOR(S) : Willhelm F. Lauener

It is certified that errors appear in the above-identified patent and that said Letters Patent should be corrected as shown below:

Col. 4, line 37, remove the "." after the word "mold"
Col. 8, line 58, "rotatable" should read –rotatably--.

Signed and Sealed this

Sixth Day of June, 2000

*Attest:*

Q. TODD DICKINSON

*Attesting Officer*

*Director of Patents and Trademarks*